United States Patent [19]

Mondloch et al.

[11] Patent Number: 4,705,271

[45] Date of Patent: Nov. 10, 1987

[54] EXERCISE APPARATUS

[75] Inventors: Michael J. Mondloch, Milwaukee; Nick Skover, Jr., Dousman, both of Wis.

[73] Assignee: Applied Power Inc., Brookfield, Wis.

[21] Appl. No.: 544,681

[22] Filed: Dec. 21, 1984

[51] Int. Cl.[4] ..... A63B 21/24

[52] U.S. Cl. ..... 272/130; 272/129; 272/134; 272/DIG. 5

[58] Field of Search ..... 272/129, 130, 134, DIG. 5

[56] References Cited

U.S. PATENT DOCUMENTS

| | | | |
|---|---|---|---|
| 3,606,318 | 9/1971 | Gilstrap | 272/130 |
| 4,235,437 | 11/1980 | Ruis et al. | 272/130 |
| 4,566,692 | 1/1986 | Brentham | 272/130 |

*Primary Examiner*—Leo P. Picard

*Attorney, Agent, or Firm*—Andrus, Sceales, Starke & Sawall

[57] ABSTRACT

An exercise apparatus includes a bench support, and an input bar pivotally mounted on the bench and movable through a work cycle in response to forces exerted by a user. A hydraulic actuator is connected to the input bar for developing a resistive force against the movement of the bar. An adjusting mechanism enables a user to vary the resistive force. A pressure transducer senses the pressure in the hydraulic actuator which is representative of the input force exerted by a user, and a potentiometer located at the pivotal connection of the input bar on the bench measures the angle of rotation of the bar which is representative of the displacement of the bar. The force and displacement input signals are employed by a microprocessor to generate output signals to a display showing the cycle count, the input force or the work accomplished by a user during each cycle.

12 Claims, 9 Drawing Figures

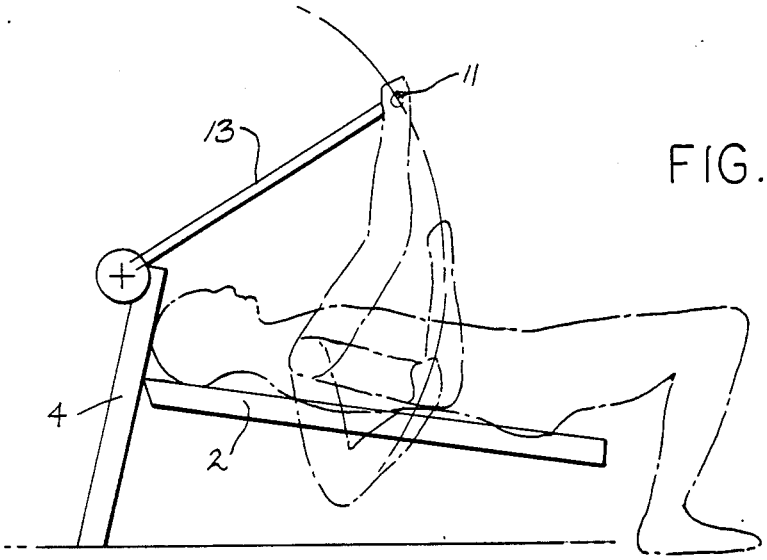
FIG. 2
FIG. 4
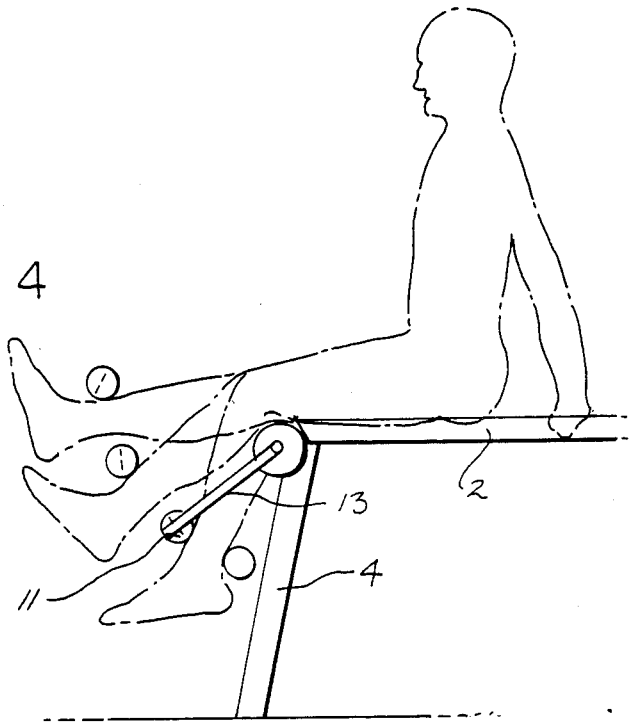
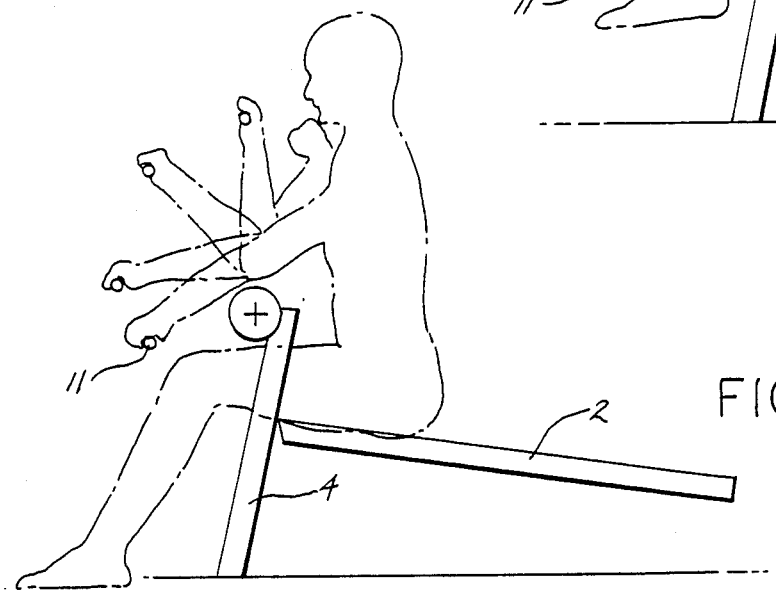
FIG. 3

OUTPUT TORQUE VS. ROTATIONAL VELOCITY

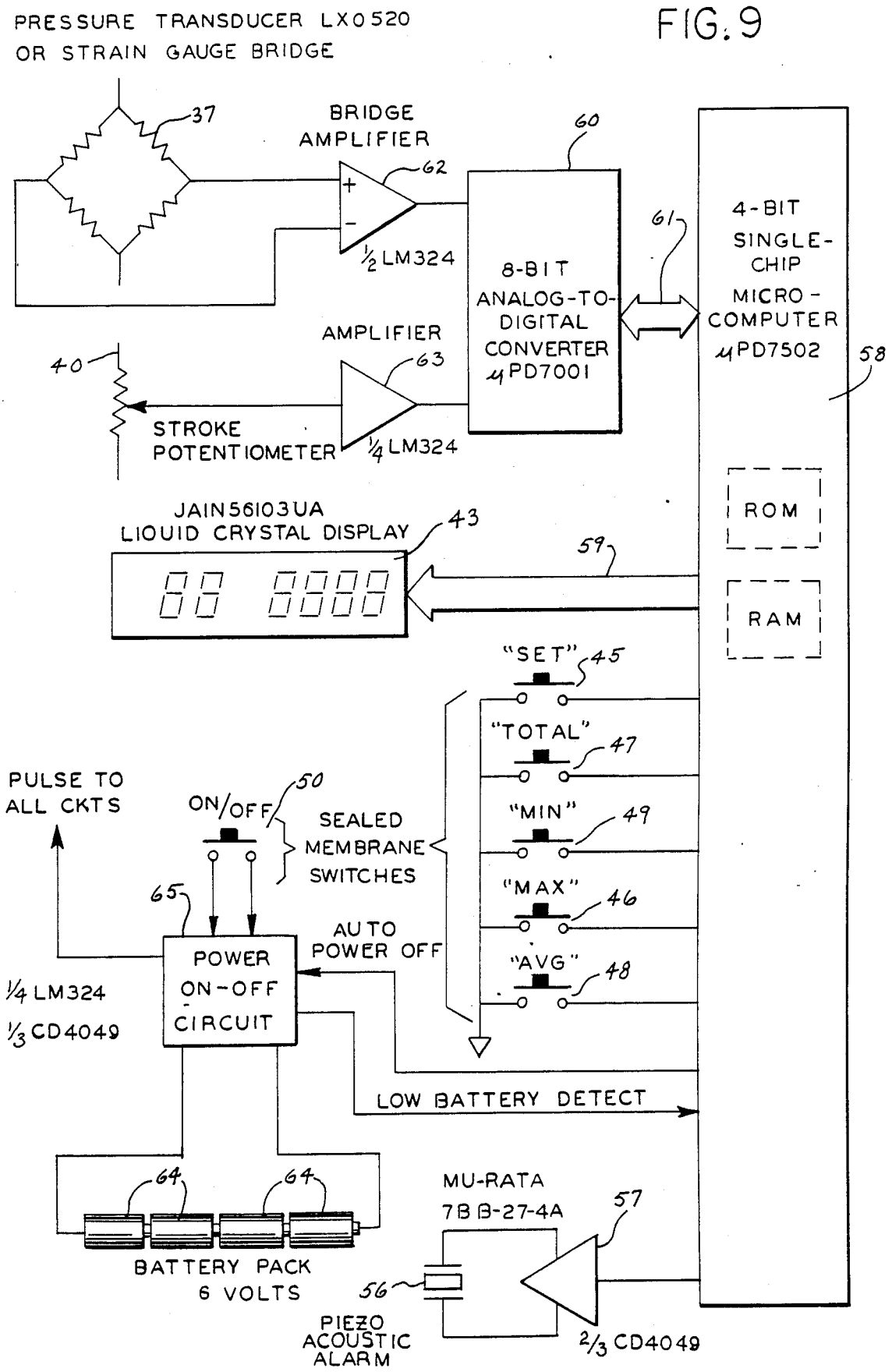
FIG. 9
PRESSURE TRANSDUCER LX0520
OR STRAIN GAUGE BRIDGE
37
BRIDGE
AMPLIFIER
62
½ LM324
60
8-BIT
ANALOG-TO-
DIGITAL
CONVERTER
μPD7001
61
4-BIT
SINGLE-
CHIP
MICRO-
COMPUTER
μPD7502
58
AMPLIFIER
63
40
STROKE
POTENTIOMETER
¼ LM324
JAIN56103UA
LIQUID CRYSTAL DISPLAY
43
59
ROM
RAM
"SET"
45
"TOTAL"
47
"MIN"
49
"MAX"
46
"AVG"
48
PULSE TO
ALL CKTS
ON/OFF
50
SEALED
MEMBRANE
SWITCHES
65
POWER
ON-OFF
CIRCUIT
AUTO
POWER OFF
¼ LM324
⅓ CD4049
LOW BATTERY DETECT
64
64
BATTERY PACK
6 VOLTS
MU-RATA
7BB-27-4A
57
56
PIEZO
ACOUSTIC
ALARM
⅔ CD4049

EXERCISE APPARATUS

REFERENCE TO APPENDICES

The decision tree flow charts of the software program for the exercise apparatus of the invention is in an appendix incorporated herein and identified by the title of this specification, by the inventors' names and by his attorney's Docket No. F. 9740-1.

A microfiche appendix containing the program listings having one (1) microfiche and a total of thirty six (36) frames is also incorporated herein.

BACKGROUND OF THE INVENTION

The present invention relates to exercise equipment, and more particularly to an exercise unit that employs a microprocessor to generate a user's cycle count, and input force and work.

Various apparatus for exercising are well-known in the art. For example, resistive devices employing weights or springs permit exercise of a muscle over the full range of movement of the muscle. In isometric devices, however, the muscle does not move after its initial contraction. One disadvantage of both of such systems, is that the muscles are not taxed to their limit throughout the entire exercise cycle.

Isokinetic systems such as those shown in U.S. Pat. Nos. 3,465,592 and 3,784,194 are also well-known in the art. Such devices develop a constant resistive force throughout the entire exercise cycle and thus the identical force resists the muscle throughout its entire range of motion. Such devices, however, have not employed microprocessor based systems which monitor cycle count, input force and work accomplished by a user.

SUMMARY OF THE INVENTION

An exercise apparatus in which a sensing means and a measuring means is employed to continuously monitor the input force exerted by a user and the displacement of an input bar during a work cycle, respectively, and means is provided for periodically reading the values of input force and displacement to calculate the work performed by a user during a work cycle. By integrating the measured work over time, the total work is calculated and available at the end of the desired number of work cycles.

The exercise apparatus includes a support, a bar member pivotally mounted on the support and moveable through a work cycle in response to input forces exerted by a user, and hydraulic actuator means connected to the bar member for developing a resistive force against the movement of the input bar. The input force is directly measured using a pressure transducer for sensing the pressure developed in the hydraulic actuator. This measurement is performed repeatedly during the sample period to continuously monitor the actual input force exerted by a user on the bar during the entire work cycle. The displacement is directly measured using a potentiometer which measures the angle of rotation of the bar with respect to the support. This measurement is also performed repeatedly during the sample period to thus continuously monitor the actual displacement of the bar member. The incremental displacement values obtained from the potentiometer are multiplied by the force values obtained from the pressure transducer to arrive at the work performed per unit time. These members are then integrated to determine the work during each cycle. The work performed during each work cycle is then added to provide a total work performed by a user during the desired number of work cycles.

In another aspect of the invention, the exercise apparatus employs microelectronics to enhance the measurement accuracy. A programmed microprocessor is employed to input values from the pressure transducer and potentiometer and to perform the calculations required to provide a number indicative of the work accomplished by a user. This number as well as other data, such as the cycle count, input force and the minimum and maximum work performed during any one cycle, may be read out through a display which is driven by the microprocessor system. The computing power of the microprocessor thus provides a highly accurate system for calculating the work performed by a user during a work cycle, as well as other desired data.

The present invention thus provides an exercise apparatus which utilizes a microprocessor to provide accurate calculation of the input force and work performed during exercising.

BRIEF DESCRIPTION OF THE DRAWINGS

The drawings illustrate the best mode presently contemplated of carrying out the invention.

In the drawings:

FIGS. 2–4 are schematic side views in elevation illustrating different manners of use of the apparatus of FIG. 1;

FIG. 9 is a schematic block diagram illustrating a typical computer based logic system for the exerciser display console of FIG. 7.

DESCRIPTION OF THE PREFERRED EMBODIMENT

Figure 1:
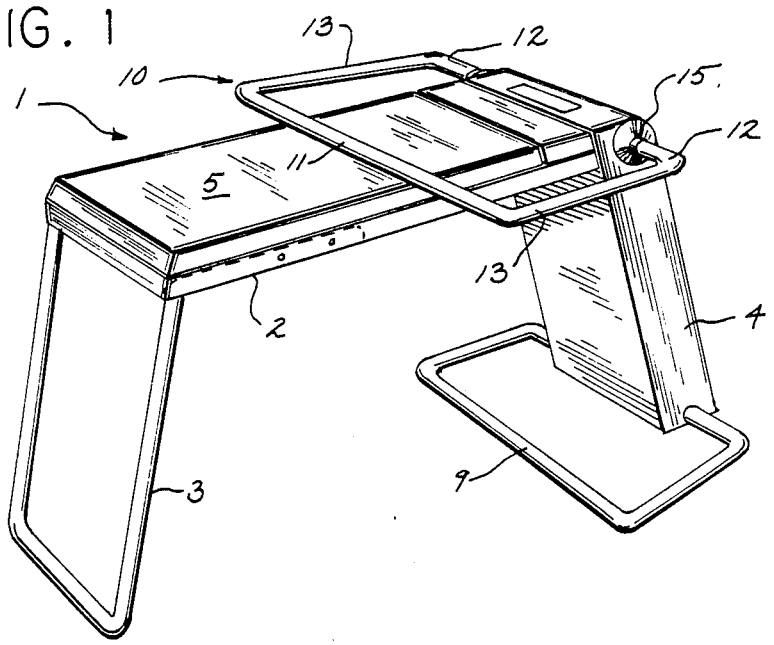
FIG. 1 is a perspective view of an exercise apparatus constructed in accordance with the principles of the present invention.

Referring now to the drawings, FIG. 1 illustrates an exercise apparatus constituting a preferred embodiment of the present invention. The exercise apparatus includes a bench 1 having a horizontally positioned platform 2, a front leg 3 and a rear leg 4. A pad 5 covers the entire top surface of platform 2. Front leg 3 is in the form of a U-shaped bar with the ends of its legs connected to the front corners of platform 2 and extending downwardly therefrom so that its web portion engages the floor or other supporting surface.

Figure 5:
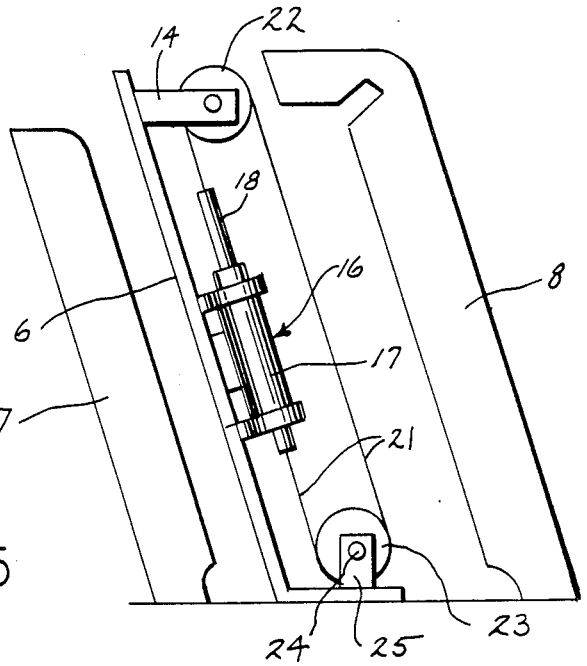
FIG. 5 is an exploded view illustrating a hydraulic actuator for developing a resistive force against the input force exerted by a user.

As shown best in FIG. 5, rear leg 4 includes an L-shaped steel support 6 covered by a shroud or housing which includes a pair of interfitting cover members 7 and 8. The upper end of support 6 is connected to the front of platform 2 so that platform 2 is held in a substantially horizontal position parallel to the ground or supporting surface. A base bar 9 is connected to the bottom of support 6 and functions to stabilize bench 1. Cover members 7 and 8 house the electronic and hydraulic components of the exercise apparatus, as will hereinafter be described.

Bench 1 also includes an operator bar 10 employed by a user for exercising various muscles. Bar 10 includes a handle or grip portion 11 extending transversely across platform 2, an input shaft 12 parallel to handle 11, and a pair of side portions 13 interconnecting handle 11 and input shaft 12. Side portions 13 maintain handle 11 in a fixed relationship with respect to input shaft 12. Input shaft 12 is journalled for rotation on a pair of brackets 14 (only one of which is shown in FIG. 5) which in turn are connected to the top of support 6. A pair of end caps 15 cover the opening leading to the interior of members 7 and 8 and also provide a means for remotely adjusting the resistance force, as will hereinafter be described.

A user of the exercise apparatus employs bar 10 to exercise various muscles by exerting an input force on handle 11. An input force on handle 11 causes a corresponding rotation or pivoting movement of bar 10 about the rotational axis of input shaft 12 as shown more clearly in FIGS. 2–4. FIGS. 2–4 illustrate different manners of use of the exercise apparatus. FIG. 2 schematically illustrates an arm press position wherein a user lies in a prone position facing upwardly and exerts a force against handle 11 to pivot bar 10 through the desired number of work cycles. A work cycle is defined as movement from an initial lower starting position to a maximum upper position and back to a lower position which is within a specified percentage such as 10–12% of the initial starting position. FIG. 3 illustrates a tricep/bicep position for performing "curls". In this position the user faces the rear of bench 1 in a sitting position with the elbows orientated in substantial alignment with input shaft 12. FIG. 4 illustrates a leg exercise position wherein a user again faces the rear of bench 1 but this time with the knee in substantial alignment with input shaft 12. It should be noted that a user may employ other exercise positions than those specifically shown in FIGS. 2–4, and the illustrations of FIGS. 2–4 are merely exemplary of the various uses for the present apparatus.

Figure 6:
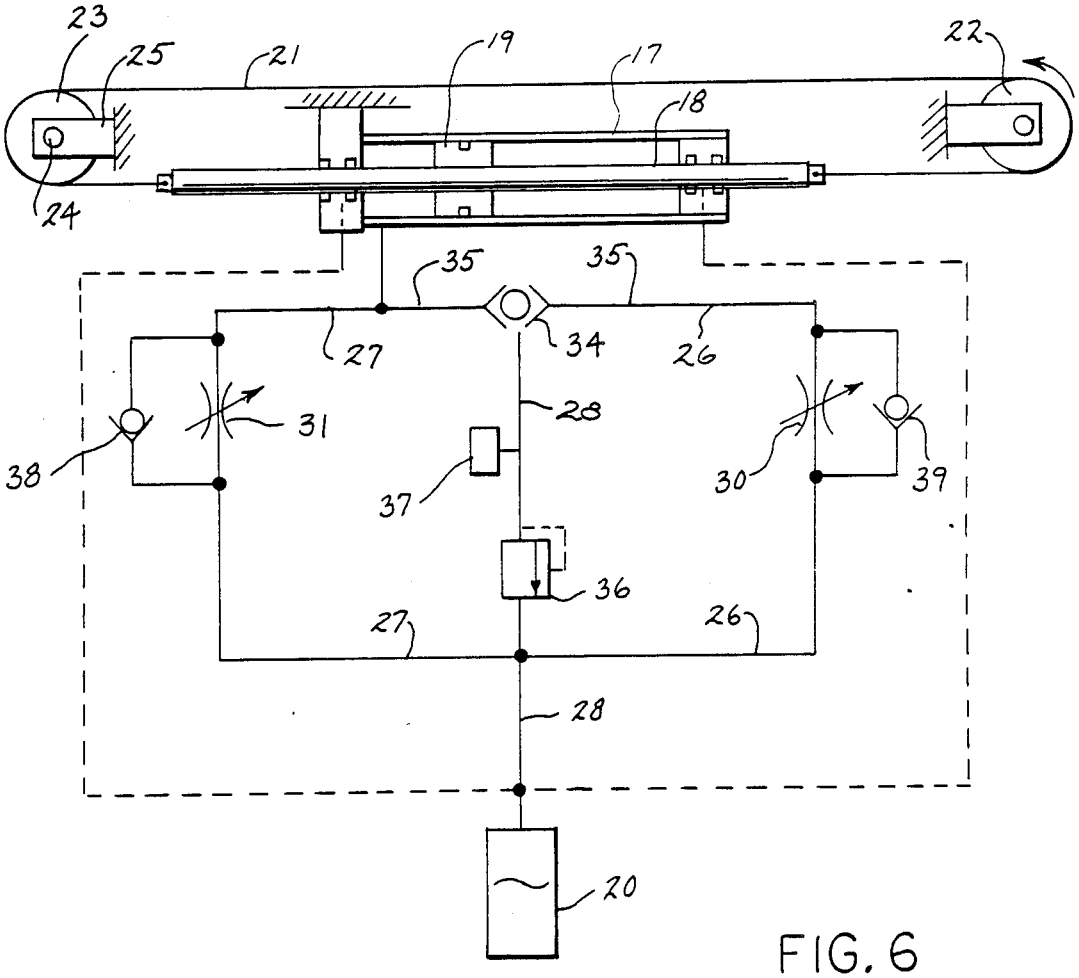
FIG. 6 is a schematic view of the hydraulic circuitry for the actuator of FIG. 5.

Referring now to FIGS. 5 and 6, there is shown a hydraulic actuator means connected to input shaft 12 for developing a resistive force against the input force exerted by user on bar 10. The actuator means includes a linear hydraulic actuator 16 fixedly mounted on support 6. Actuator 16 includes a cylinder 17, a rod 18 slidably mounted for reciprocal movement within cylinder 17 and extending through opposite ends of cylinder 17, a piston 19 on rod 18 within cylinder 17 intermediate the ends of rod 18, and hydraulic circuitry communicating between a fluid reservoir 20 and opposite ends of piston 19. A chain 21 interconnects bar 10 with actuator 16 so that rotation of the input shaft 12 of bar 10 through a work cycle causes a corresponding linear reciprocal movement of rod 18. Chain 21 is connected at one end to the upper end of rod 18 and at its other end to the lower end of rod 18. Chain 21 is also trained about a pair of sprockets 22 and 23, respectively. As shown best in FIG. 5, gear 22 is mounted at the upper end of leg 4 on input shaft 12 between brackets 14. Thus, sprocket 22 is mounted coaxially with the axis of rotation of bar 10 for coincident rotation with bar 10. Sprocket 23 is an idler gear and is mounted for rotation on a shaft 24 which in turn is journalled in a pair of brackets 25 (only one of which is shown in FIG. 5) which in turn are mounted to the horizontal portion of support 6. Thus, rotational input or displacement of sprocket 22 causes a corresponding rotation of sprocket 23 and linear displacement of rod 18 and piston 19.

As shown in FIG. 6, the hydraulic circuitry for actuator 16 includes a first hydraulic line 26 communicating at one end with the interior of cylinder 17 on the right hand side of piston 19, and a second hydraulic line 27 communicating at one end with the interior of cylinder 17 on the left hand side of piston 19. Hydraulic lines 26 and 27 communicate at their other ends with a third hydraulic line 28 which leads to reservoir 20. Each line 26–27 includes fluid restriction means for regulating the flow of fluid therethrough. The fluid restriction means in lines 26 and 27, however, are adjustable to enable a user to vary the resistive force developed by actuator 16. The adjustable fluid restriction means in lines 26 and 27 comprise a pair of variable orifices 30 and 31, respectively. As shown best in FIG. 7, the flow of fluid through orifices 30 and 31 is adjustable by means of a pair of control members 32 and 33, respectively. Control members 32 and 33 are mounted on valve block 41 of actuator 16 and may be turned down inwardly to restrict flow through lines 26 and 27 to increase the effort needed to move piston 19, or may be backed off to increase the flow of fluid through lines 26 and 27 to decrease the effort needed to move piston 19. It should also be noted that members 32 and 33 may be rotated independently of one another so that a user may adjust the input effort independently in both directions of rotation of operator bar 10. Control members 32 and 33 are preferably connected to end caps 15 by means of a flexible cable (not shown) so that effort control may be variably adjusted by rotation of end caps 15.

Returning now to FIG. 6, the hydraulic circuitry for actuator 16 also includes a pair of check valves 38 and 39 for bypassing orifices 30 and 31 depending upon the direction of fluid flow within lines 26 and 27. The hydraulic circuitry also includes a shuttle valve 34 interposed in a hydraulic line 35 which interconnects lines 26 and 27. Hydraulic line 28 communicates with the outlet of shuttle valve 34 and has a safety relief valve 36 interposed therein. Relief valve 36 is interposed between reservoir 20 and shuttle valve 34. A pressure transducer 37 is also connected in line 28 between relief valve 36 and shuttle valve 34. Pressure transducer 37 functions to sense the pressure in line 28 between shuttle valve 34 and relief valve 36 which is representative of the input force exerted by a user on bar 10 during a work cycle in either direction of movement of bar 10.

Thus, when sprocket 22 is rotated counterclockwise piston 19 moves to the right as shown in FIG. 6 and forces fluid from line 26 through orifice 30 into line 27. Fluid in line 27 bypasses orifice 31 and instead passes through check valve 38 into the left hand side of cylinder 17. During this operation, fluid also passes from line 26 into line 35 and through shuttle valve 34 to relief valve 36 so that pressure transducer 37 may sense the pressure therein and provide a signal indicative of that pressure which in turn is indicative of the input force exerted by a user on bar 10. When sprocket 22 rotates in a clockwise direction so that piston 19 moves to the left, fluid is forced through line 27 and orifice 31 into line 26 where it bypasses orifice 30 and passes through check valve 39 into the righthand side of cylinder 17. At the same time, pressure from line 27 passes through line 35 and shuttle valve 34 into line 28 where pressure transducer 37 can sense the pressure and provide a signal indicative of the input force exerted by a user on operator bar 10 during a work cycle. The shuttle valve 34 thus permits the use of only one pressure transducer 37 which always senses the high pressure end of hydraulic actuator 16. Relief valve 36 is only actuated if the pressure within line 28 increases beyond its predetermined maximum pressure setting.

Figure 7:
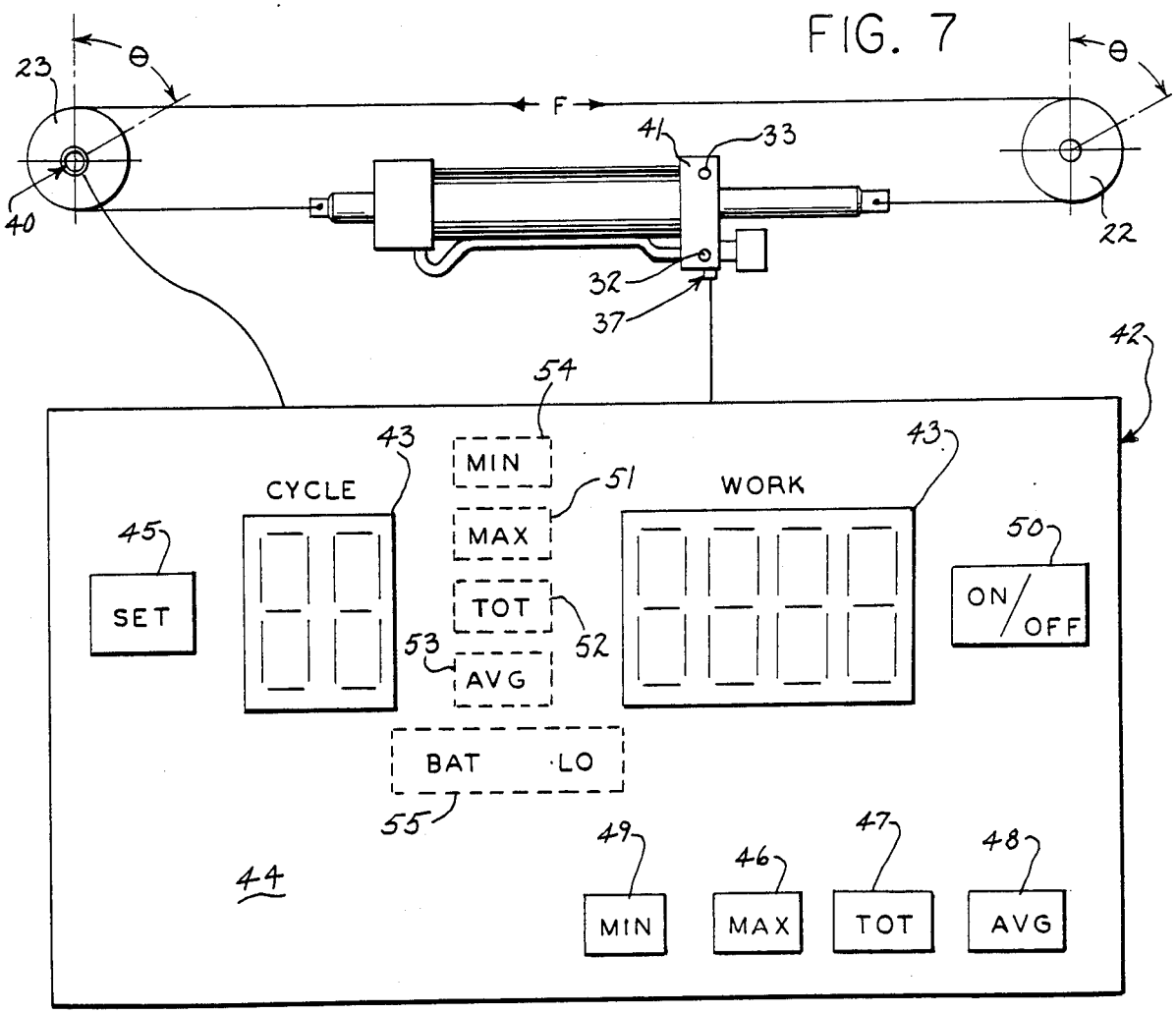
FIG. 7 is a schematic view illustrating the hydraulic actuator interconnected with a typical exerciser display console.

Turning now to FIG. 7, the exercise apparatus of the present invention further includes measuring means for measuring the displacement of operator bar 10 during a work cycle. This measuring means includes a potentiometer located at the pivotal connection of bar 10 to support 6. Potentiometer 40 functions to measure the angle of rotation of bar 10 with respect to bench 1 which angle is representative of the displacement of bar 10 during a work cycle. Preferably, potentiometer 40 is located on sprocket 22, and may be of any conventional construction. The potentiometer 40 includes an optional slip clutch (not shown) which limits rotation of the potentiometer to about 180° to improve measurement resolution. If bar 10 rotates beyond 180° such as when its position is reversed from that shown in FIG. 2 to that shown in FIGS. 3 or 4, the slip clutch permits the entire potentiometer to rotate up to a maximum of about 270°. However, it should be noted that the potentiometer 40 only measures about 180° of rotation and the slip clutch thus functions to permit the potentiometer to measure displacement in a variety of positions for bar 10. As shown in FIG. 7, the displacement signal from potentiometer 40 is communicated to a microprocessor where it is multiplied by the force signal from the pressure transducer 37 in the microprocessor software logic, as will hereinafter be described, to generate the user's input force and work during each cycle.

Figure 8:
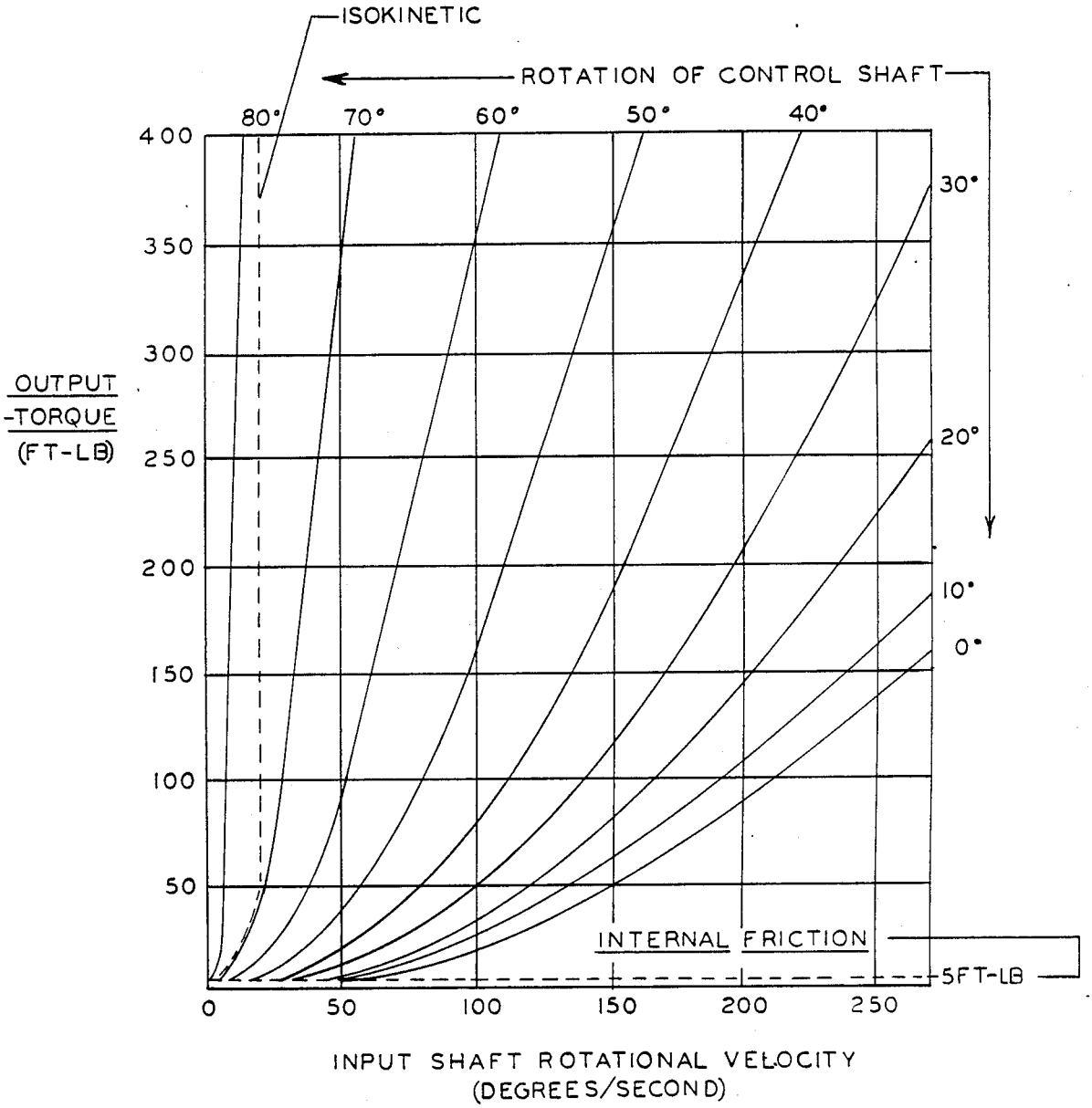
FIG. 8 is a graph of output torque versus rotational velocity of the input shaft as a function of the setting of an adjustable effort control on the hydraulic actuator.

FIG. 8 graphically illustrates an example of the quasi-isokinetic characteristics of the present exercise apparatus. FIG. 8 shows that the torque required to rotate operator bar 10 is a function of the adjustment of control members 32 and 33 and the rotational velocity of input shaft 12. Thus, with members 32 and 33 set at approximately 20° it would take approximately 80 foot pounds to rotate input shaft 12 at 150° per second while at 50° the same rotational velocity of input shaft 12 would require 350 foot pounds of torque.

Referring again to FIG. 7, it can be seen that the signals generated by transducer 37 and potentiometer 40 are communicated to a display/control console 42. Console 42 includes display means 43 as well as the various components of the microcomputer which will hereinafter be described all of which are mounted on a circuitboard (not shown). Console 42 is preferably mounted within the top of cover member 8 having an opening formed therethrough so that a user may visually observe display means 43, as seen best in FIG. 1. A six switch membrane keyboard 44 covers the opening in member 8 on the outer surface thereof. Although shown as being integrally attached to rear leg 4, console 42 may also be an independent unit separate from the exercise apparatus, or console 42 could be attached to bar 10 in any appropriate manner so that a user may visually observe the exercise data provided thereby while the user is operating bar 10.

Display means 43 functions to display various exercise data such as cycle count, input force and work performed by a user. Display means 43 is preferably a six-digit quadraplexed liquid crystal display with five custom enunciators. As shown in FIG. 7, two digits are employed to display the number of cycles performed or desired to be performed by the user. The remaining four digits are employed to display the work performed by a user during one or more cycles. These same four digits could also be employed to display the input force or power i.e. work per unit time of a user on bar 10 if desired. Keyboard 44 is a six-switch membrane panel. and for each exercise position, an operator can push various buttons to generate a number of different types of display parameters. A SET button 45 is pushed to zero the readout displays at the beginning of each exercise type and to enter the desired number of work cycles. A MAX button 46 is pushed to give the maximum work accomplished during any one cycle and the number of that cycle. A TOT button 47 is pushed to give the total work accomplished for the total number of cycles shown. An AVG button 48 is pushed to give the average work accomplished for the total number of cycles shown. A MIN button 49 is pushed to give the minimum work accomplished during any one cycle and the number of that cycle. An ON/OFF button 50 is pushed to provide power to the system or to turn off the system. Four of the enunciators 51–54 correspond respectively to the buttons 46–49 and the fifth enuciator 55 displays a battery low condition. Thus, when a user pushes MAX button 46 not only is the work in foot-pounds displayed in the liquid crystal display 43 and the number of that cycle in which the maximum work was performed appear, but also the MAX enunciator 51 is illuminated to inform the user which button was pushed. As shown in FIG. 7, enunciators 51–55 are preferably positioned between the cycle and work displays. However, enunciators 51–55 may be positioned in any other convenient manner as desired. Buttons 45–50 may also be positioned as desired, and FIG. 7 merely shows one desired manner for such positions. Other buttons and enunciators may be added as required to accommodate the display of force, power, etc.

A microcomputer based control system is housed in console 42. As shown in FIG. 9, the control system receives two inputs. First, it receives an input from pressure transducer 37 which is indicative of the input force applied by a user on bar 10. Transducer 37 may be a LX0520 strain gauge bridge available from Sensym Inc. of Sunnyvale, California. Secondly, the control system receives the displacement signals from potentiometer 40. Potentiometer 40 may be a JA1N056103UA available from the Allen-Bradley Company of Milwaukee, Wisconsin. In response to these input signals, the control system provides output signals to the liquid crystal display 43 depending upon which button 45–49 is pushed by a user. The control system also provides an output to a piezo-acoustic alarm 56. Alarm 56 may be a 7BB-27-4A available from Mu-Rata/Erie Company and is operational through an driver 57 which may be comprised of a CD 4049 integrated circuit available from National Semiconductor. Alarm 56 sounds after the desired number of cycles which has been preset by the user has been performed to inform the user that the desired number of cycles has been accomplished.

Although various logic control systems may be used, the computer based control system illustrated herein provides a convenient and practical method of implementing the necessary control functions with the degree of accuracy required. A construction which has been used is shown in FIG. 9. Flow charts for the preferred software program illustrating the various functions and sequences for such a computer based system are shown in an appendix to the specification. The program listings for the computerized system is contained in a microfiche appendix for this specification. The flow charts and program listings will be readily understood by those skilled in the art on the basis of the following discussion.

Thus, referring to FIG. 9, console 42 includes a four-bit single chip microcomputer 58 which may be a uPD7502 unit manufactured and sold by NEC Electronics USA of Natick, Massachusetts. Microcomputer 58 includes an internal program memory which controls the sequencing and provides the appropriate processing of information by the microcomputer 58. As previously noted, console 42 includes the necessary input and output device and particularly includes the six switch membrane keyboard 44 and liquid crystal display 43 for selective insert of the necessary requests and commands by the operator and the display to indicate the value of the desired function. The microcomputer 58 is coupled to the display 43 through a suitable bus 59 in accordance with well-known practice and construction.

The sensed output of transducer 37 is an analog signal and this signal is communicated to an eight bit analog to digital converter 60 which converts the analog signal to an appropriate digital signal for processing by microcomputer 58. Converter 60 may be a uPD7001 available from NEC Electronics USA of Natick, Massachusetts, and is coupled to microcomputer 58 through a suitable bus 61 of conventional construction. Transducer 37 is connected to converter 60 through a bridge amplifier 62 which may be comprised of an LM324 available from National Semiconductor. Potentiometer 40 is also connected to converter 60 through an amplifier 63 which may be comprised of an LM 324 available from National Semiconductor.

The system also includes a main power supply for maintaining appropriate operation of microcomputer 58. The main power supply is preferably a battery pack of four conventional 1.5 volt batteries 64 connected through a power on/off circuit 65 to microcomputer 58. On/off circuit 65 may include a CD4049 Hex-Inverting buffer available from National Semiconductor. The system also includes an automatic power off feature which may be comprised of an LM324 quad-operational amplifier also available from National Semiconductor which automatically shuts off the display if no work strokes are performed or if none of buttons 45–49 are pressed for approximately 10 minutes to preserve batteries 64. Further, the system includes a low battery detect which illuminates enunciator 55 to inform the user that batteries 64 need to be replaced.

The following electronic operating sequence illustrates the manner of use of the exercising apparatus of the present invention. A user first pushes ON/OFF button 50 to supply power to the system. Display 43 shows cycles (00) and work blank. The user then presses SET button 45. The number of cycles increment upwardly once for each time SET button 45 is pressed. In other words if 10 cycles are desired, SET button 45 may be pushed 10 times. Alternately, if SET button 45 is pressed and held for more than one second, the cycles value increments upwardly automatically at approximately a 2 Hz rate as long as the button is pressed. Next, the user adjusts the effort control for actuator 16 by rotating control members 32 and 33 through remote external end caps 15.

The user then begins a stroke on bar 10. The computer measures the stroke angle sensed by potentiometer 40 to the point where the direction of bar 10 is reversed. When the user returns bar 10 to within a specified percentage of its starting point, a work cycle is completed. The cycle display is decremented by one, and the work display now shows the work for that cycle. With each additional stroke, the cycle display is decremented and the work from the last cycle is added to the work previously displayed. When the cycle display is decremented to zero, alarm 56 sounds. At this point, any additional strokes are ignored by the computer until the set button 45 is pressed. The cycle display remains at "00" and the work displayed is the total work for all cycles.

At this point, the user can select one of five options. First, pressing the MIN button 49 causes the cycle number and work for the minimum effort cycle to be displayed. Pressing the MAX button 46 causes the cycle number and work for the maximum effort cycle to be displayed. Pressing the AVG button 48 causes the average work per cycle and the total number of cycles to be displayed. Pressing the TOT button 47 causes the total work and total number of cycles to be displayed. Pressing the SET button 45 causes the work display to blank out and loads the previously entered number of cycles into the cycle display, thus allowing the user to repeat the exercise set if desired. Pressing the SET button 45 a second time clears the previous number of cycles entered. Once SET button 45 is pressed, the previously accummulated total, average, minimum and maximum work and cycles are cleared. From this point, all new exercise strokes are displayed.

At any time during the series of cycles, the user may stop exercising and examine the minimum, maximum, average or total work. If the remaining cycles had not yet been decremented to zero, any further strokes will revert the display back to the totalizing mode, accummulating strokes until the cycles are decremented to zero. At any point in time, the user may press the ON/-OFF button 50 to turn off the display. All display values will then be lost. Pressing the ON/OFF button 50 again will reactivate system and display 43. If no strokes are performed and no buttons 45–49 are pressed for approximately 10 minutes, display 43 will automatically shut itself off in order to preserve batteries 64. All display values will be lost after automatic power down.

An exercise apparatus has been illustrated and described which includes a microcomputer based control system for providing various desirable data to a user.

Various modes of carrying out the invention are contemplated as being within the scope of the following claims particularly pointing and distinctly claiming the subject matter which is regarded as the invention.

We claim:

1. An exercise apparatus, comprising:

a support;

a bar member pivotally mounted on said support and movable through a work cycle in response to input forces exerted by a user;

hydraulic actuator means connected to said bar member for developing a resistive force against the movement of said bar member, said actuator means includes a hydraulic cylinder, a rod slidably mounted for reciprocal movement within said cylinder and extending through opposite ends thereof, a piston on said rod within said cylinder intermediate the ends of said rod, and hydraulic circuitry including a first hydraulic line communicating between a fluid reservoir and one side of said piston, a second hydraulic line communicating between the fluid reservoir and the other side of said piston, first and second fluid restriction means in said respective first and second hydraulic lines for regulating the flow of fluid through said first and second hydraulic lines, a shuttle valve having a first inlet communicating with said first hydraulic line between said first fluid restriction means and said one side of said piston, a second inlet communicating with said second hydraulic line between said second fluid restriction means and said other side of said piston, and an outlet, a third hydraulic line communicating between the outlet of said shuttle valve and the fluid reservoir, and a relief valve interposed in said third hydraulic line between said shuttle valve outlet and the fluid reservoir responsive to outlet pressure from said shuttle valve;

means for sensing pressure in said actuator means representative of the input force exerted by a user on said bar member during a work cycle, said pressure sensing means comprising a single pressure transducer communicating with said third hydraulic line between said shuttle valve outlet and said relief valve;

means for measuring an angle of rotation of said bar member representative of the displacement of said bar member during a work cycle; and calculating means using solely the values of the input force from said single force transducer and displacement to calculate the work performed by a user during a cycle.

2. The exercise apparatus of claim 1, wherein said bar member includes grip means spaced from said pivotal connection and engageable by a user.

3. The exercise apparatus of claim 1, further including a visual display which shows the work accomplished by a user.

4. The exercise apparatus of claim 1, wherein each of said fluid restriction means includes an orifice, and a check valve disposed in parallel relationship therewith.

5. The exercise apparatus of claim 4, wherein each of the orifices of said fluid restriction means is adjustable to enable a user to vary the resistive force.

6. The exercise apparatus of claim 1, wherein said measuring means comprises a potentiometer located at the pivotal connection of said bar member to said support.

7. The exercise apparatus of claim 1, further including means interconnecting said bar member and the rod of said actuator means so that rotation of said bar member through a work cycle causes a corresponding linear reciprocal movement of said rod.

8. The exercise apparatus of claim 7, wherein said interconnecting means includes a first gear mounted on said support adjacent one end of said cylinder coaxially with the pivotal connection of said bar member to said support for coincident rotation with said bar member, a second idler gear mounted on said support adjacent the other end of said cylinder, and a chain member trained out said gears and having one end connected to one end of said row and its other end connected to the other end of said rod.

9. The exercise apparatus of claim 1, further including means for storing the initial displacement value representative of a start position of said bar member, and means for comparing the actual position of said bar member with said initial start position to determine whether a work cycle has been completed by a user.

10. An exercise apparatus, comprising:

a support;

a bar member pivotally mounted on said support and movable through a work cycle relative to said support in response to input forces exerted by a user, said work cycle defined as movement from an initial lower starting position to an upper position and back to a lower position which is within a desired percentage of the initial starting position;

actuator means connected to said bar member for developing a resistive force against the movement of said bar member;

sensing means for sensing the input force exerted by a user during a work cycle said sensing means comprising a single force transducer;

measuring means for measuring the displacement of said bar member during a work cycle; and calculating means using solely the values of input force from said single force transducer and displacement to calculate the work performed by a user during a work cycle, said calculating means including means for storing a value representative of the initial lower starting position of said bar member, and means for comparing the actual position of said bar member with said initial start position to determine whether a work cycle has been completed by a user.

11. The exercise apparatus of claim 10, further including a visual display which shows the work accomplished by a user and the number of cycles performed by a user.

12. The exercise apparatus of claim 10, wherein said desired percentage comprises about 10–12%.

* * * * *